US006055711A

United States Patent [19]

Weil et al.

[11] Patent Number: 6,055,711

[45] Date of Patent: May 2, 2000

[54] FR POLYESTER HOSPITALITY FABRICS

[75] Inventors: Albert J. Weil, Greensboro; E. Keith Adams, Mount Gilead, both of N.C.; Jeffrey L. Moorman, Atavista, Va.; Lawrence J. Hulighan, Greensboro, N.C.

[73] Assignee: Burlington Industries, Inc., Greensboro, N.C.

[21] Appl. No.: 09/014,284

[22] Filed: Jan. 27, 1998

[51] Int. Cl.[7] ..... D03D 23/00

[52] U.S. Cl. ..... 28/151; 28/167; 28/169; 139/383 R; 139/420 A; 5/500; 5/502

[58] Field of Search ..... 28/151, 165, 167, 28/169, 100; 139/383 R, 420 A; 26/1; 5/502, 500

[56] References Cited

U.S. PATENT DOCUMENTS

| | | | |
|---|---|---|---|
| 4,100,725 | 7/1978 | Magel | 57/206 |
| 4,365,466 | 12/1982 | Horiuchi et al. | 57/205 |
| 4,473,996 | 10/1984 | Kuroda et al. | 57/245 |
| 4,663,927 | 5/1987 | Takemae et al. | 57/6 |
| 4,812,139 | 3/1989 | Brodmann | 8/490 |
| 4,815,500 | 3/1989 | Goineau | 139/21 |
| 5,223,197 | 6/1993 | Boles et al. | 264/103 |
| 5,244,718 | 9/1993 | Taylor et al. | 428/229 |
| 5,261,472 | 11/1993 | Knox et al. | 139/420 A |
| 5,413,598 | 5/1995 | Moreland | 623/1 |
| 5,424,117 | 6/1995 | Heiman et al. | 428/229 |
| 5,466,514 | 11/1995 | Kataoka et al. | 442/81 |

OTHER PUBLICATIONS

Textile Design and Colour, Watson, 4th Edition, Longmans Green and Co., admitted prior art, pp. 125–130.

"New Yarns, Texturing Techniques Explored at TYAA Annual Meeting", *Modern Textiles,* Sep., 1997, pp. 27–28.

"Trevira for FR Enters Hospitality Market", *Textile World,* Jun., 1986, p. 35.

"Flame–Retardant Textiles", *Medical Textiles,* Jul., 1988, p. 8

"Milliken's Versatile VISA®", *America's Textiles International,* Jun., 1992, p. 104.

"New Trevira FR Polyester is First All–Spun, Low–Pill Type", *Inside Textiles,* Apr. 5, 1993, p. 2.

"The Importance of Proper Fabric Selection" by William C. Smith, *Journal of Coated Fabrics,* Jul. 26, 1996, pp. 8–25.

"Hoffman Mills Gets Into Contract Fabrics", *Home Textiles Today,* Mar. 31, 1997 at p. 14.

Burlington Test Procedure "Physical Properties; Pilling–Random Tumble C–03", Mar., 1995.

Burlington Test Procedure "Physical Properties; Brush Pilling C–02", Mar., 1995.

Burlington Test Procedure "Physical Properties; Roughing + Pilling C–05", Mar., 1995.

Trevira Brochure "Fibers That Will Go Through Fire For You", 1996.

*Primary Examiner*—Amy B. Vanatta

*Attorney, Agent, or Firm*—Nixon & Vanderhye P.C.

[57] ABSTRACT

A fabric is constructed by weaving on a loom, with a loom setting of between about 78%–88% in the greige, using false twist textured polyester warp yam (about 140–160 denier, preferably about 150 denier with about 55–65 filaments in either single or 2 ply form) and air textured polyester weft yam (2-ply or 3-ply about 140–160 denier, preferably about 150 denier with about 90–110 filaments, preferably about 100 filaments), and finishing the fabric by scouring (on a jet or on a continuous scouring range) and printing or jet dyeing, and then heat setting at temperature of at least about 350° F. The fabric scores between 4.5 and 5.0 on each of random tumble pilling, brush pilling, and Klopman method roughing and pilling, tests. The fabric also has a surface SMD of at least about 4.3, a bending rigidity 2HB of about 0.1 or less, a compressibility EMC% of less than about 28, a shearing stiffness G value of about 2 or less, and an extensibility EMT% of at least about 3.0. The fabric is especially suitable in the hospitality trade, e.g. for curtains and bedspreads.

23 Claims, 5 Drawing Sheets

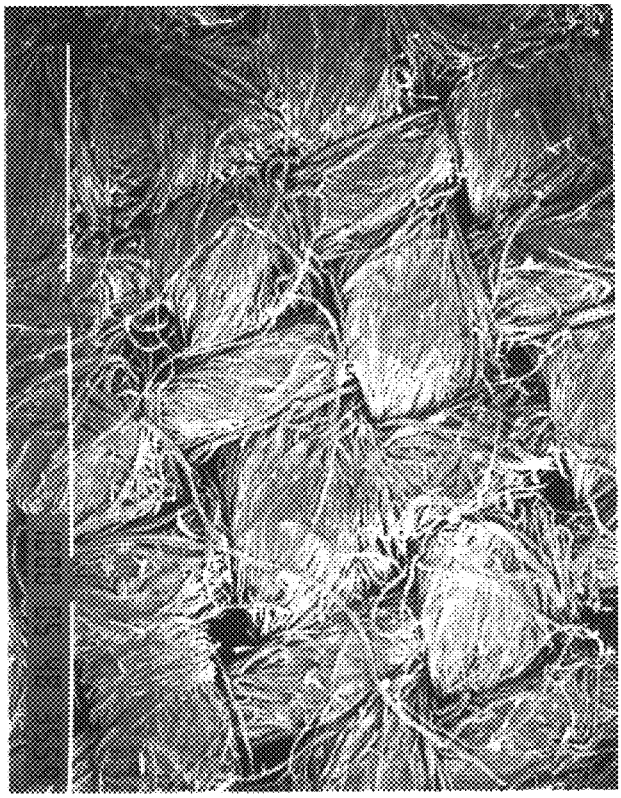
FIG. 2 (Prior Art)
22
FIG. 3 (Prior Art)
23
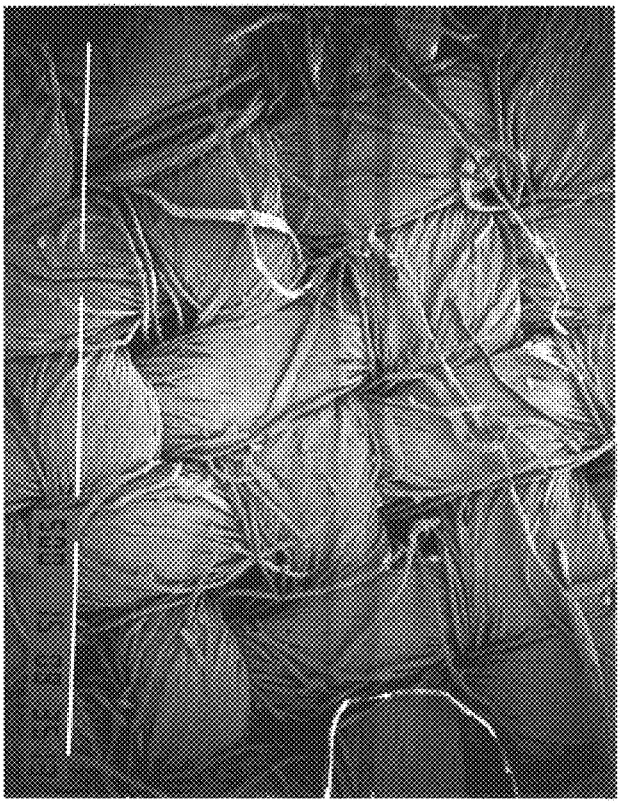

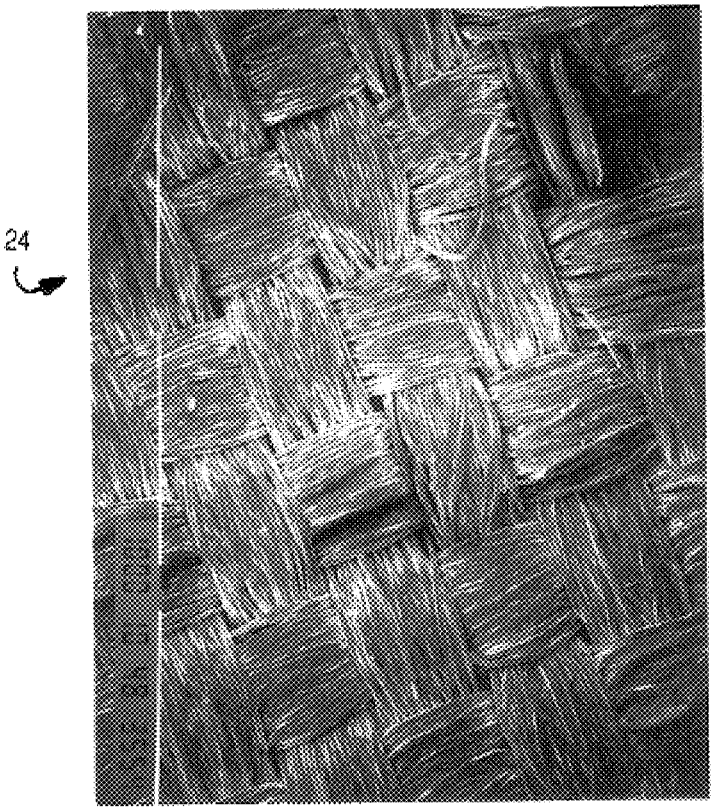
FIG. 4
(Prior Art)
FIG. 5 (Prior Art)
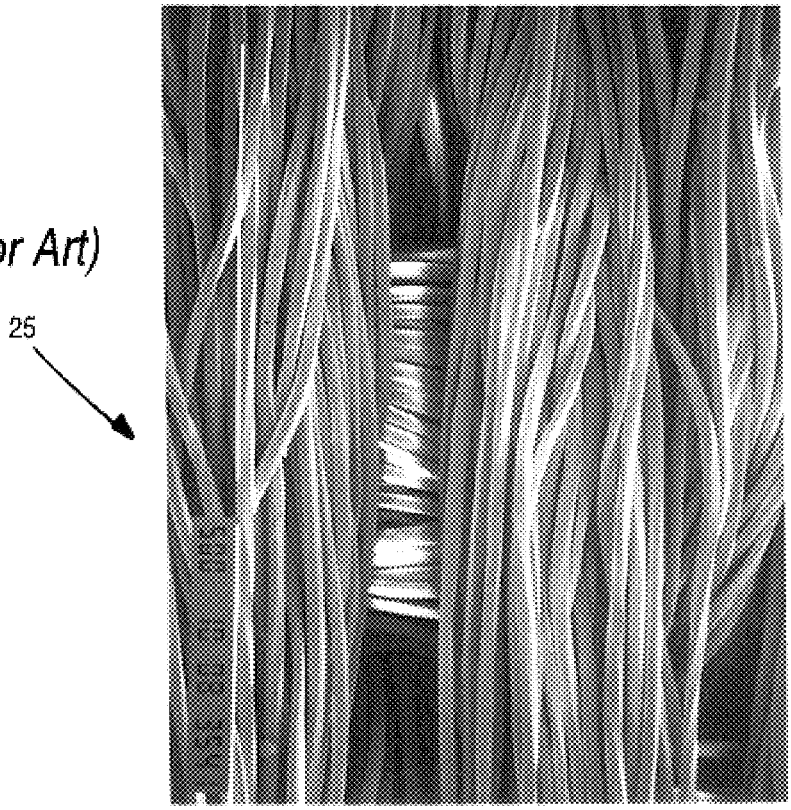

FR POLYESTER HOSPITALITY FABRICS

BACKGROUND AND SUMMARY OF THE INVENTION

In the hospitality market, it is highly desirable to be able to make curtains and bedspreads which have good aesthetic values, yet has no pilling or snagging, and overall excellent performance characteristics. Cotton and spun polyester fabrics have good hand but during wear produce fuzzing and pilling. One hundred percent false twist filament polyester products do not significantly pill or fuzz, but do cause snagging (picking) in continued usage. The polyester filament products according to the invention, on the other hand, produce a surface effect that combines the best of the above mentioned products, with no pilling or snagging, as well as having pleasing aesthetics and overall excellent performance. Products according to the invention have been tested through 50 commercial launderings without showing any wear or deterioration. The finished fabric according to the present invention when tested on a Kawabata testing system for aesthetic values, compared to 100% spun and 100% filament polyester fabrics, has more suppleness and drape, a higher co-efficient of friction and a much rougher surface (enhancing in bedspreads reduction in slippage when on a bed, and improving seam slippage in fabricating either bedspreads or curtains), a vast increase in pliability, resulting in better draping of curtains and forming of bedspreads, and excellent bending characteristics, emphasizing softness of hand and pliability.

According to one aspect of the present invention a method of providing a useful fabric is provided. The method comprises the steps of: (a) Weaving on a loom, with a loom setting of between about 78%–88% of firm setting in the greige, a fabric using: a false twist textured polyester warp yarn, about 140–160 denier, preferably about 150 denier with about 55–65 (e.g. about 60) filaments in either single or 2-ply form; and an air textured polyester 2-ply or 3-ply about 140–160 denier, preferably about 150 denier weft yam with about 90–110, preferably about 100, filaments. And, (b) finishing the fabric from step (a).

Step (b) may be practiced by (b1) scouring, (b2) heat setting, and (b3) printing. Step (b1) is practiced on a jet, and step (b2) at a temperature of about 350° or above. Alternatively step (b) is practiced by (b1) scouring on a continuous scouring range, (b2) dyeing on a jet dyeing machine, and (b3) heat setting. Alternatively step (b) is practiced by (b1) scouring, (b2) dyeing, and (b3) heating setting at a temperature of at least 350° F., or scouring (b1), heat setting (b2), and printing (b3).

The method may comprise the further steps of: (c) Cutting and forming the fabric to produce curtains. And (d) suggesting to another that the curtains be hung adjacent a transparent or translucent structural element. Alternatively, the method may comprise the further steps of: (c) Cutting and forming the fabric to produce a bedspread. And (d) suggesting to another that the bedspread be placed on a mattress or other bed structure.

Steps (a) and (b) may be practiced to produce a fabric scoring between about 4.5 and 5.0 on each of random tumble, pilling, brush pilling, and Klopman method roughing and pilling, tests. Steps (a) and (b) may be further practiced to produce a fabric having a surface SMD of at least about 4.3 microns, a bending rigidity 2 HB of about 0.1 or less, a compressibility EMC % of less than about 28, a shearing stiffness G value of about 2 or less, and an extensibility EMT % of at least about 3.0.

According to another aspect of the present invention a method of providing a useful fabric is provided comprising the following steps: (a) Weaving a fabric from textured polyester warp and weft yams. (b) Scouring, printing or dyeing, and heat setting the fabric. And, (c) wherein steps (a) and (b) are practiced to produce a fabric scoring between about 4.5 and 5.0 on each of random tumble, pilling, brush pilling, and Klopman method roughing and pilling tests, and to produce a fabric having a surface SMD of at least about 4.3 microns, a bending rigidity 2 HB of about 0.1 or less, a compressibility EMC % of less than about 28, a shearing stiffness G value of about 2 or less, and an extensibility EMT % of at least about 3.0.

According to another aspect of the present invention a mounted curtain is provided comprising the following components: A woven body having false twist textured polyester warp yam, about 150 denier with about 55–65 filaments in either single or 2-ply form, and an air textured polyester 2 or 3 ply about 150 denier weft yam with about 100 filaments. Stitching and pleating forming the woven body into a curtain. And, curtain mounting hardware mounting the curtain adjacent a structural element. In the mounted curtain described above the fabric scores between about 4.5 and 5.0 on each of random tumble pilling, brush pilling, and Klopman method roughing and pilling tests, and also has aesthetic qualities described above. The invention also relates to a curtain produced according to the method steps as described above for producing curtains.

According to another aspect of the present invention a bedspread disposed on a mattress or other bed structure is provided comprising: A woven body having false twist textured polyester warp yarn, about 150 denier with about 55–65 filaments in either single or 2-ply form, and an air textured polyester 2 or 3 ply about 150 denier weft yarn with about 100 filaments. Stitching and hemming forming the woven body into a bedspread. And, the bedspread laid on a mattress or other bed structure. The fabric used to make the bedspread as described above has the aesthetic properties also described above, and is preferably produced by the method for making a bedspread also earlier described.

According to yet another aspect of the present invention a woven polyester fabric having textured warp and weft yams is provided wherein the fabric scores between about 4.5 and 5.0 on each of random tumble pilling, brush pilling, and Klopman method roughing and pilling tests, has a surface SMD of at least about 4.3 microns, a bending rigidity 2 HB of about 0.1 or less, a compressibility EMC % of less than about 28, a shearing stiffness G value of about 2 or less, and an extensibility EMT % of at least about 3.0. The fabric is typically printed or dyed.

It is the primary object of the present invention to provide a polyester fabric having no pilling or snagging along with pleasing aesthetics and overall excellent performance characteristics, and particularly desirable for the hospitality market, for making products directed to that market. This and other objects of the invention will become clear from an inspection of the detailed description of the invention and from the appended claims.

BRIEF DESCRIPTION OF THE DRAWINGS

FIGS. 2 through 5 are microphotographs of exemplary fabrics over which the invention is an improvement;

DETAILED DESCRIPTION OF THE DRAWINGS

Figure 1:
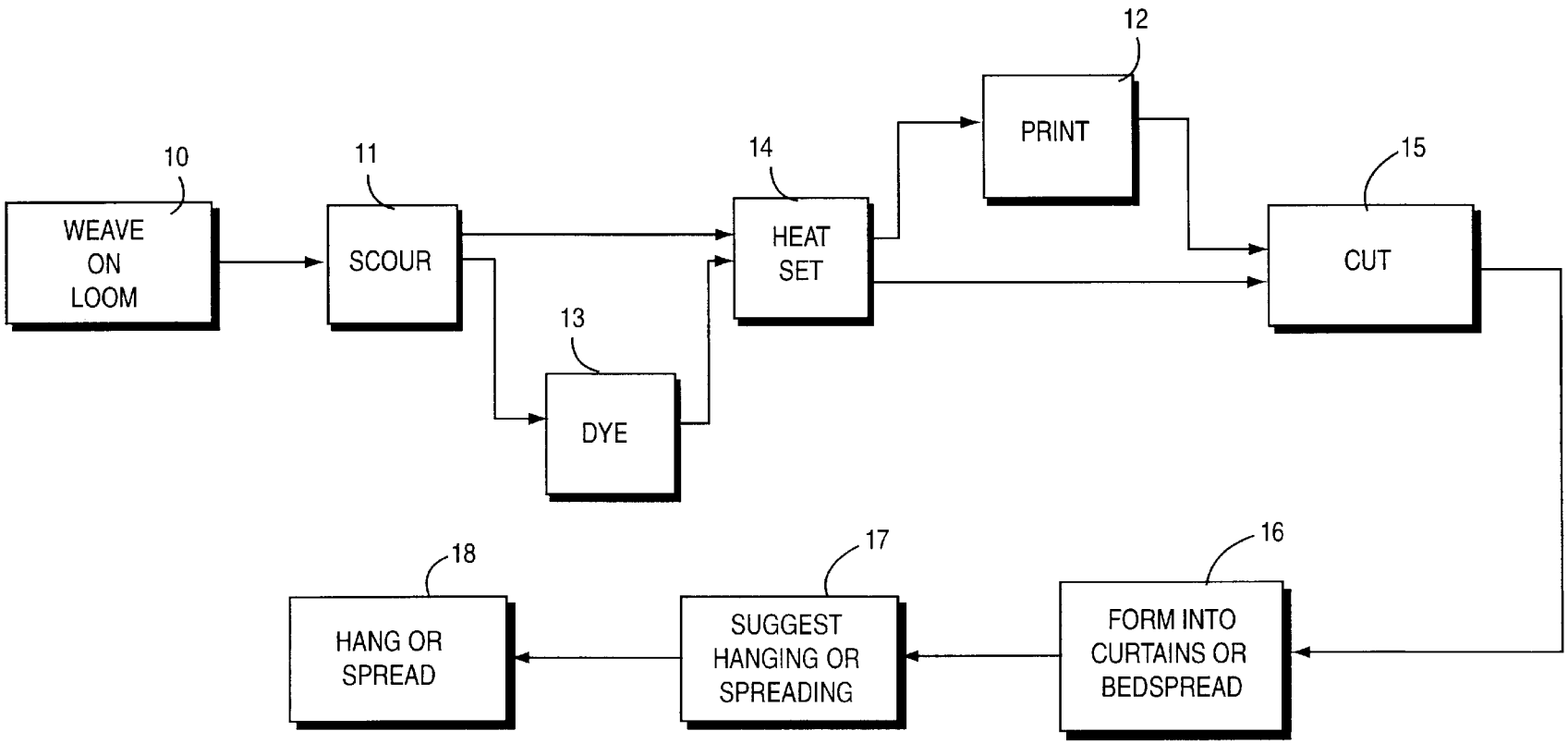
FIG. 1 is a schematic representation of an exemplary method according to the present invention.

An exemplary method for providing a useful fabric according to the present invention is schematically illustrated in FIG. 1. The fabric is preferably made from false twist textured warp yam and air textured filling (weft) yarn. The warp yarn is about 140–160 denier, preferably about 150 denier yam with about 55–65 filaments in either single or 2-ply form. The weft yam is about 140–160 denier, preferably about 150 denier yam with about 90–110 filaments, preferably about 100 filaments, in either 2-ply or 3-ply form. Both the warp and weft are preferably 100% polyester yarns, and preferably commercially available Trevira FR (fire resistant) yarns (available from Trevira of Shelby, N.C.), which are known to produce fabrics that have desired properties when they are constructed according to the invention.

The first step in the practice of the method according to the present invention is to weave the fabric on a loom as indicated schematically at 10 in FIG. 1. The fabric is constructed with a minimum loom setting of about 78% of firm setting in the greige based on the Ashenhurst Rule, and a maximum of about 88% of firm setting. This range allows for outstanding performance while still preserving aesthetics.

The resultant greige fabric produced on the loom 10 is either processed in a prepared for print form, or dyed, after scouring at 11. The print embodiment is illustrated schematically at 12 in FIG. 1 while the dyed embodiment is illustrated schematically at 13. For the print 12 routing, scouring at box 11 can be practiced on a jet, or on a continuous scouring range, the deciding factor being the desired suppleness. For maximum suppleness the fabric is processed on a jet at 11. If the fabric is processed in the dye routing 13, the fabric is preferably scoured at 11 on a continuous scouring range, and dyed at 13 using a conventional jet dyeing machine or the like. Regardless which of the details of the options 11–13 are selected, the fabric is heat set—as indicated at 14 in FIG. 1—utilizing conventional equipment at a minimum temperature of about 350° F. For the print option 12, heat setting at 14 preferably precedes printing, and for the dye option 13 preferably dyeing precedes heat setting at 14.

After the formation of the fabric is completed, as indicated by steps 10 through 14 (with optional additional processing steps being provided if desired), the fabric is then cut at 15, using conventional cutting equipment (either manual or automatic), and then is desirably formed into useful products for the hospitality market, such as curtains or bedspreads, as illustrated schematically at 16 in FIG. 1. Formation of the fabric into curtains or bedspreads is also conventional per se, conventional sewing machines and the like being utilized to form appropriate hems, pleats, stitching, or the like. The method also typically includes suggesting that the curtains be hung or the bedspreads be spread, as indicated at 17, and ultimately the end users will hang the curtains and spread the bedspreads, as indicated schematically at 18 in FIG. 1.

FIGS. 2 through 7 are microphotographs of various constructions of fabric according to the prior art, other attempts, and the invention. FIG. 2 shows the typical appearance of prior art all cotton staple spun yarn, having a degree of hairiness and non-uniformity, as illustrated schematically at 22. [The construction of FIG. 2 will hereinafter be referred to as style "III".] FIG. 3 illustrates, as generally indicated by reference numeral 23, spun polyester (Trevira F/S), again a staple spun yarn with a certain degree of hairiness and non-uniformity.

FIG. 4 illustrates a 100% false twist filament product produced from Trevira FR, and illustrated schematically at reference numeral 24, and will be hereinafter referred to as style "V". FIG. 5 illustrates schematically at reference numeral 25 another 100% false twist filament product and will be hereinafter referred to as style "VI".

Figure 6:
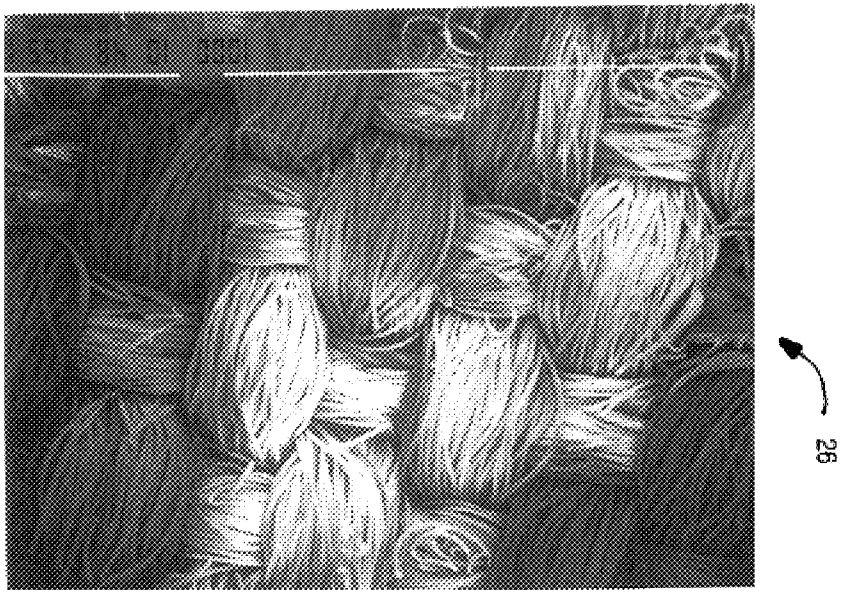
FIGS. 6 and 7 are microphotographs of two different embodiments of fabrics according to the present invention.
Figure 7:
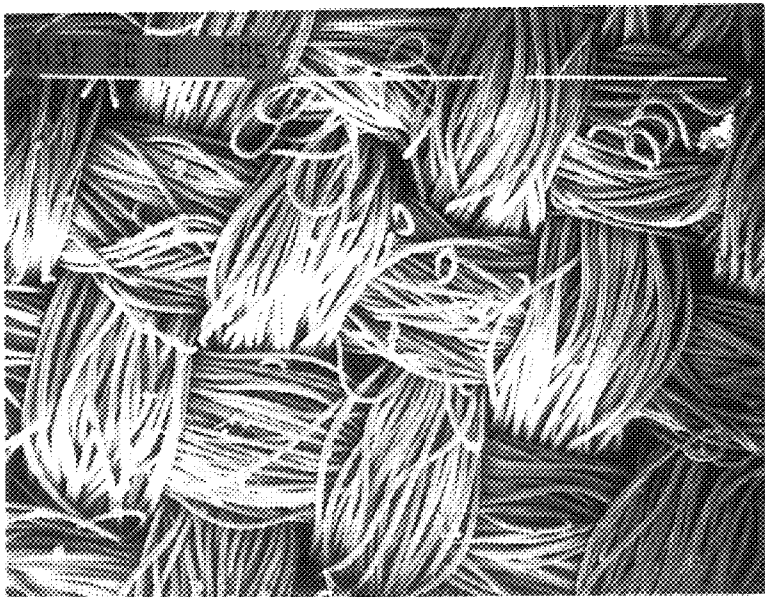

The 100% filament products produced with a combination of false twist and air textured yarns, as according to the present invention, are illustrated generally by reference numerals 26 and 27, respectively, in FIGS. 6 and 7. The particular construction 26 of FIG. 6 will be hereinafter referred to as style "I", while the fabric 27 in FIG. 7 will be hereinafter referred to as style "II".

Figure 8:
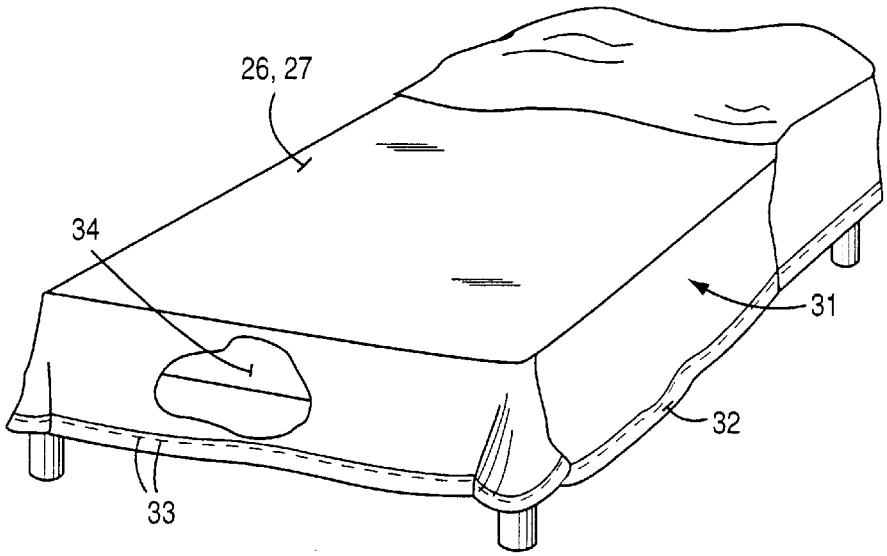
FIG. 8 is a schematic perspective view of an exemplary bedspread made utilizing the fabric according to the invention.

FIG. 8 illustrates, schematically, a bedspread 31 made from a fabric like the fabric 26, 27, being formed in stages 15, 16 of FIG. 1 into a bedspread having hems 32 and stitching 33, and the like. FIG. 8 illustrates the bedspread 31 spread over a mattress 34, or other bed structure (e.g. box spring, bed board, etc.), the bedspread 31 being ideal for use in the hospitality market.

Figure 9:
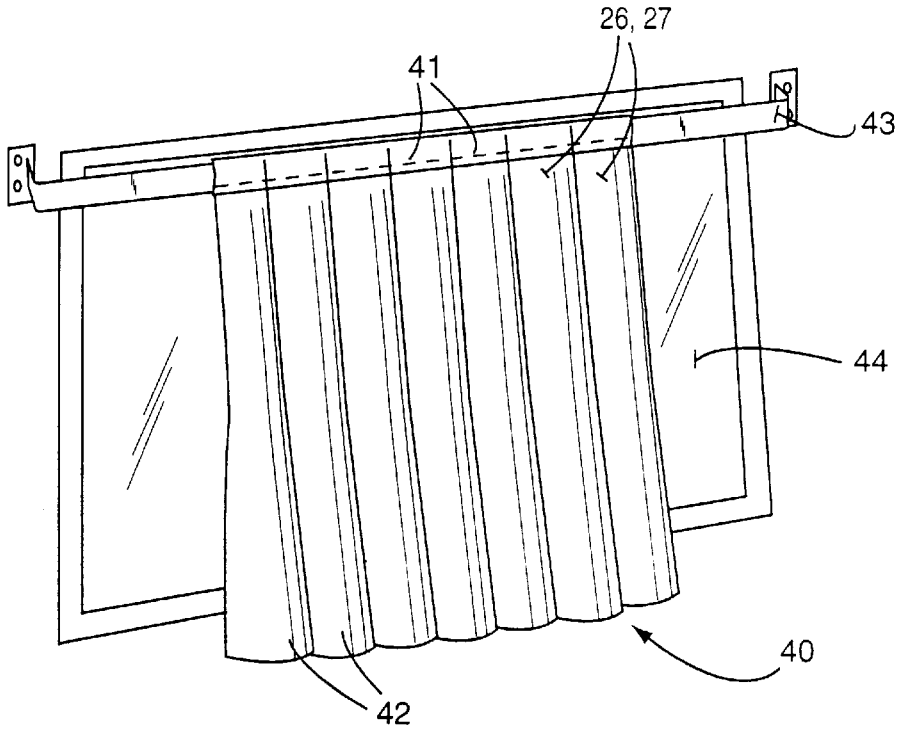
FIG. 9 is a top perspective schematic view of an exemplary mounted curtain made according to the teachings of the present invention.

FIG. 9 schematically illustrates a curtain 40 produced from the fabric 26, 27. The curtain 40 is produced in steps 15, 16 of FIG. 1, and include appropriate stitching 41, pleats 42, and the like, and are hung by conventional mounting hardware illustrated schematically at 43 in FIG. 9. The curtains 40 cover, or are adjacent a transparent or translucent structural element, such as the window pane 44.

The fabrics 26, 27 according to the invention, and the bedspread 31 and curtains 40 constructed therefrom, may easily survive 50 commercial launderings with no wear or deterioration. These fabrics do not experience fuzzing and pilling during wear, like the staple spun yam fabrics (such as the fabric 22, style III). While the fabrics 24, 25 (styles V and VI) have uniformly parallel orientation of the continuous filaments which do not significantly pill or fuzz, they do cause snagging (picking) in continued usage. The fabrics 26, 27 according to the present invention have none of the fuzzing, pilling, or snagging problems associated with the prior art constructions, and therefore are as close to indestructible as presently technically feasible, while still retaining excellent aesthetic properties.

The fabrics 26, 27, and the products 31, 40 made therefrom, according to the present invention score between about 4.5 and 5.0 on each of random tumble pilling, brush pilling, and Klopman method roughing and pilling, tests. Despite this excellent performance, the products have a surface SMD of at least about 4.3 microns (e.g. at least about 4.5 microns), a bending rigidity 2 HB of about 0.1 or less (preferably about 0.09 or less), a compressibility EMC% of less than about 28 (e.g. about 25 or less), a shearing stiffness G value of about 2 or less (preferably about 1.5 or less), and an extensibility EMT% of at least about 3.0 (e.g. at least about 3.2).

For the purposes of understanding the tables which follow, and which indicate actual testing of the fabrics according to the invention compared to the prior art fabrics, yam diameters, calculated pursuant to the Ashenhurst Rule, are as follows:

| | | |
|---|---|---|
| Yarn Diameter | 1/150/60 : | 156.0 |
| | 2/150/60 : | 110.3 |
| | 2/150/100: | 110.3 |
| | 2/150/100: | 90.1 |

Styles I, II, and VII in the following tables are pursuant to the invention, while styles III–VI are not according to the invention. The details of these styles (some of which have already been illustrated in FIGS. 2 through 7, as indicated above) are as follows:

| | | |
|---|---|---|
| Style: I | Warp: | 2/150/60 Trevira FR — False Twist Textured |
| | Filling: | 2/150/100 Trevira FR — Air Textured |
| | Count: | 54 × 40 |
| | Warp: | 97.9% |
| | Filling: | 72.5% |
| | Fabric: | 85.2% |
| Style: II | Warp: | 1/150/60 Trevira FR — False Twist Textured |
| | Filling: | 2/150/100 Trevira FR — Air Textured |
| | Count: | 60 × 44 |
| | Warp: | 92.8% |
| | Filling: | 68.1% |
| | Fabric: | 80.5% |
| Style: VII | Warp: | 2/150/60 Trevira FR — False Twist Textured |
| | Filling: | 3/150/100 Trevira FR — Air Textured |
| | Count: | 62 × 34 |
| | Warp: | 90.6% |
| | Filling: | 68.6% |
| | Fabric: | 79.6% |
| Style: III | Warp: | 15/1 Cotton |
| | Filling: | 10/1 Cotton |
| | Greige Count: | 51 × 43 |
| Style: IV | Warp: | 22/1 Trevira FR |
| | Filling: | 22/1 Trevira FR |
| | Greige Count: | 62 × 54 |
| Style: V | Warp: | 1/150/60 Trevira FR False Twist Textured |
| | Filling: | 1/150/60 Trevira FR False Twist Textured |
| | Greige Count: | 62 × 54 |
| Style: VI | Warp: | 1/150/60 Trevira FR False Twist Textured |
| | Filling: | 2/150/60 Trevira FR False Twist Textured |
| | Greige Count: | 132 × 45 |

The following table I illustrates the actual test results for the fabric styles according to the invention, compared with styles III–VI, using three different pilling tests. The random tumble pilling and brush pilling tests are standard industry tests. The brush pilling test, pursuant to ASTM D3511, determines the tendency of fabrics to form pills of fuzz under test conditions intended to simulate normal wear and utilizes a testing machine including two rotation platforms, nylon brushes mounted on a brush holder, and fabric specimens mounted on fabric specimen holders. The details of the test procedure are well known in the art.

The random tumble pilling test causes fabrics to form pills by a random rubbing motion produced by tumbling specimens in a cylindrical chamber lined with cork. Again the test procedures are well known.

The Klopman method roughing and pilling test is similar to the other tests only it adds sand paper to simulate maximum wear. Pills are formed on fabric by random rubbing motions produced by tumbling a sample in a cylindrical chamber lined with cork and flint paper, such as a Norton-Mohawk extra coarse flint paper 3 inches×5¾ inches and placed over a fresh cork liner.

In all of the test reports in table I, a score of 5.0 indicates excellent resistance (no pilling), a score of 4.0 indicates good resistance (slight pilling), a score of 3.0 medium resistance (moderate pilling), a score of 2.0 poor resistance (heavy pilling), and a score of 1.0 very poor resistance (very severe pilling). If a rating for a test specimen falls between two ratings a half value is assigned. Typically an average of three tests/ratings is given, although in some cases in table I all three test results are given rather than averaged. In the tests reported in table I all of the fabric styles were tested in the same way, with the same equipment, pursuant to the standard procedures for each of the tests involved.

TABLE I

| Fabric Style | Type | Random Tumble | Klopman Method Roughing & Pilling | Brush Pilling |
|---|---|---|---|---|
| VII | Original | 5.0, 5.0, 5.0 | 5.0, 5.0, 5.0 | 5.0 |
| | 10X | 5.0, 5.0, 5.0 | 5.0, 5.0, 5.0 | 5.0 |
| | 25X | 5.0, 5.0, 5.0 | 5.0, 5.0, 5.0 | 5.0 |
| | 40X | 5.0, 5.0, 5.0 | 5.0, 5.0, 5.0 | 5.0 |
| | 50X | 5.0, 5.0, 5.0 | 5.0, 5.0, 5.0 | 5.0 |
| I | Original | 5.0, 5.0, 5.0 | 5.0, 5.0, 5.0 | 5.0 |
| | 10X | 5.0, 4.5, 5.0 | 5.0, 4.5, 5.0 | 5.0 |
| | 25X | 5.0, 4.5, 5.0 | 5.0, 5.0, 5.0 | 5.0 |
| | 40X | 5.0, 5.0, 5.0 | 5.0, 5.0, 4.5 | 5.0 |
| | 50X | 4.5, 4.5, 4.5 | 5.0, 5.0, 5.0 | 5.0 |
| II | Original | 5.0, 5.0, 5.0 | 5.0, 5.0, 5.0 | 5.0 |
| | 10X | 5.0, 4.5, 5.0 | 5.0, 5.0, 5.0 | 5.0 |
| | 25X | 5.0, 5.0, 5.0 | 5.0, 5.0, 5.0 | 5.0 |
| | 40X | 4.5, 4.5, 4.5 | 4.5, 5.0, 5.0 | 5.0 |
| | 50X | 4.5, 4.5, 4.5 | 4.5, 4.5, 5.0 | 5.0 |
| III | | 4.0–5.0 | 4.0 | 4.5–5.0 |
| IV | | 2.5–4.0 | 4.0 | 1.5–3.0 |
| V | | 5.0 | 4.0 | 5.0 |
| VI | | 5.0 | 4.0 | 4.5–5.0 |

Styles I through VI were also tested for aesthetic values (quantified values) using the Kawabata Evaluation System (KES). The KES is used for measuring mechanical hand properties. The KES instruments measure the mechanical properties that correspond to the fundamental deformation of fabrics in hand manipulation. Five different tests may be performed using KES, generating eighteen different mechanical characteristics. The details of all of the tests, for compression, surface, tensile, shearing stiffness, and bending rigidity, are standard, and the tests reported in table 11 were obtained by the North Carolina State University College of Textiles in Raleigh, N.C. using the KES equipment located there in 1997.

The test results reported in table II indicate that spun fabrics need up to twice the force to be compressed as do the fabrics according to the invention, resulting in more suppleness and drape of the fabrics according to the invention.

As far as surface roughness is concerned, the fabrics according to the present invention showed a slightly higher co-efficient of friction than the spun products and over a 100% rougher surface. This enhances bedspreads in reducing the movement (slippage) when on a bed, and improves seam slippage in fabricating either bedspreads or curtains.

The shearing tests provide a measure of stiffness and pliability. Products according to the invention are approximately three times more pliable than spun products, resulting in better draping of curtains and forming of bedspreads.

With respect to bending, the products according to the invention required one-third to 100% less force to bend. This further emphasizes the softness of hand and pliability of the fabrics according to the present invention compared to spun products.

TABLE II

| Property | Style I | Style II | Style III | Style IV | Style V | Style VI |
|---|---|---|---|---|---|---|
| KES TACTILE PROPERTIES | | | | | | |
| Weight (oz/yd$^2$) | 5.57 | 4.03 | 5.52 | 4.51 | 3.79 | 5.86 |
| Thickness (mm) | 0.46 | 0.38 | 0.52 | 0.32 | 0.18 | 0.45 |
| Compression | | | | | | |
| LC (–) | 0.03 | 0.03 | 0.02 | 0.02 | 0.07 | 0.04 |
| WC (gf* cm/cm$^2$) | 0.07 | 0.06 | 0.12 | 0.07 | 0.04 | 0.08 |
| RC (%) | 62.28 | 66.79 | 56.79 | 69.39 | 86.19 | 59.67 |
| EMC (%)[a] | 18.70 | 24.00 | 49.00 | 36.10 | 14.20 | 18.10 |
| Surface | | | | | | |
| MIU (–) | 0.18 | 0.20 | 0.18 | 0.17 | 0.19 | 0.25 |
| MMD (–) | 0.02 | 0.03 | 0.02 | 0.03 | 0.04 | 0.02 |
| SMD (micron)[b] | 4.66 | 6.00 | 2.97 | 3.01 | 4.02 | 2.08 |
| Tensile | | | | | | |
| LT (–) | 0.75 | 0.70 | 0.84 | 0.75 | 0.74 | 0.65 |
| WT (gf* cm/cm$^2$) | 7.32 | 5.49 | 6.84 | 6.65 | 5.19 | 5.87 |
| RT (%) | 56.69 | 62.92 | 50.85 | 67.89 | 69.84 | 67.82 |
| EMT (%)[c] | 3.99 | 3.21 | 3.28 | 3.40 | 2.86 | 3.59 |
| Shearing Stiffness | | | | | | |
| G (gf/cm* Degree)[d] | 1.34 | 0.81 | 6.28 | 9.16 | 1.24 | 0.58 |
| 2HG (gf/cm) | 0.74 | 0.30 | 7.66 | 2.47 | 0.55 | 0.52 |
| 2HG5 (gf/cm) | 5.29 | 3.09 | 16.03 | 15.97 | 4.60 | 2.41 |
| Bending Rigidity | | | | | | |
| B (gf* cm$^2$/cm)[e] | 0.22 | 0.20 | 0.35 | 0.38 | 0.17 | 0.21 |
| 2HB (gf* cm/cm) | 0.09 | 0.07 | 0.26 | 0.14 | 0.05 | 0.06 |

[a]A higher EMC value indicates the material is more compressible under 50 gf/cm$^2$.
[b]A higher SMD value indicates a rougher fabric surface.
[c]A higher EMT value indicates greater extensibility, or it possesses a higher degree of stretchability.
[d]A higher G value indicates stiffness to the shearing motion (lower G is softer/more pliable).
[e]A higher B value indicates greater bending rigidity. (Lower B is more bendable).

Thus, according to the present invention, a woven polyester fabric having textured warp and weft yams having the desirable properties indicated particularly for styles I and II above, has been provided, as well as methods of the fabrication thereof, and related useful end products (including bedspreads and curtains) using such fabrics. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of making a useful fabric c article made from the fabric, comprising the steps of:

(a) weaving on a loom, with a loom setting of between about 78%–88% of firm setting in the greige, a fabric using: a false twist textured polyester warp yarn, about 140–160 denier, with about 55–65 filaments in either single or 2-ply form; and an air textured polyester 2-ply or 3-ply about 140–160 denier weft yarn with about 90–110 filaments; and (b) finishing the fabric from step (a).

2. A method as recited in claim 1 wherein step (b) is practiced by (b1) scouring, (b2) heat setting, and printing.

3. A method as recited in claim 2 wherein step (b1) is practiced on a jet, and step (b2) at a temperature of about 350° for above.

4. A method as recited in claim 1 wherein step (b) is practiced by (b1) scouring on a continuous scouring range, (b2) dyeing on a jet dyeing machine, and (b3) heat setting.

5. A method as recited in claim 1 wherein step (b) is practiced by, sequentially, (b1) scouring, (b2) dyeing, and then (b3) heating setting at a temperature of at least 350° F., or (b1) scouring, (b2) heat setting at a temperature of at least 350° F., and then (b3) printing.

6. A method as recited in claim 5 comprising the further steps of: (c) cutting and forming the fabric to produce curtains that can be hung adjacent a transparent or translucent structural element.

7. A method as recited in claim 5 comprising the further steps of: (c) cutting and forming the fabric to produce a bedspread which can be placed on a mattress or other bed structure.

8. A method as recited in claim 1 wherein steps (a) and (b) are practiced to produce a fabric scoring between about 4.5 and 5.0 on each of random tumble, pilling, brush pilling, and Klopman method roughing and pilling, tests.

9. A method as recited in claim 8 wherein steps (a) and (b) are also practiced to produce a fabric having a surface SMD of at least about 4.3 microns, a bending rigidity 2 HB of about 0.1 or less, a compressibility EMC % of less than about 28, a shearing stiffness G value of about 2 or less, and an extensibility EMT % of at least about 3.0.

10. A method as recited in claim 6 wherein steps (a) and (b) are practiced to produce a fabric scoring between about 4.5 and 5.0 on each of random tumble, pilling, brush pilling, and Klopman method roughing and pilling, tests, and wherein steps (a) and (b) are also practiced to produce a fabric having a surface SMD of at least about 4.3 microns, a bending rigidity 2 HB of about 0.1 or less, a compressibility EMC % of less than about 28, a shearing stiffness G value of about 2 or less, and an extensibility EMT % of at least about 3.0.

11. A method as recited in claim 1 wherein both said warp and weft yarns are about 150 denier, and wherein said weft yarn comprises about 100 filaments, and said warp yam about 60 filaments.

12. A method as recited in claim 6 wherein steps (a) and (b) are practiced to produce a fabric scoring between about 4.5 and 5.0 on each of random tumble, pilling, brush pilling, and Klopman method roughing and pilling, tests.

13. A method as recited in claim 7 wherein steps (a) and (b) are practiced to produce a fabric scoring between about 4.5 and 5.0 on each of random tumble, pilling, brush pilling, and Klopman method roughing and pilling, tests.

14. A method as recited in claim 7 wherein steps (a) and (b) are practiced to produce a fabric scoring between about 4.5 and 5.0 on each of random tumble, pilling, brush pilling, and Klopman method roughing and pilling, tests, and wherein steps (a) and (b) are also practiced to produce a fabric having a surface SMD of at least about 4.3 microns, a bending rigidity 2 HB of about 0.1 or less, a compressibility EMC % of less than about 28, a shearing stiffness G value of about 2 or less, and an extensibility EMT % of at least about 3.0.

15. A method as recited in claim 5 wherein both said warp and weft yarns are about 150 denier, and wherein said weft yarn comprises about 100 filaments, and said warp yarn about 60 filaments.

16. A method as recited in claim 8 wherein both said warp and weft yarns are about 150 denier, and wherein said weft yarn comprises about 100 filaments, and said warp yarn about 60 filaments.

17. A method as recited in claim 3 comprising the further steps of: (c) cutting and forming the fabric to produce curtains that can be hung adjacent a transparent or translucent structural element.

18. A method as recited in claim 3 comprising the further steps of: (c) cutting and forming the fabric to produce a bedspread that can be placed on a mattress or other bed structure.

19. A method as recited in claim 4 comprising the further steps of: (c) cutting and forming the fabric to produce curtains that can be hung adjacent a transparent or translucent structural element.

20. A method as recited in claim 4 comprising the further steps of: (c) cutting and forming the fabric to produce a bedspread that can be placed on a mattress or other bed structure.

21. A method of making a useful fabric or article made from the fabric comprising the steps of:

(a) weaving a fabric from textured polyester warp and weft yarns;

(b) scouring, printing or dyeing, and heat setting the fabric; and (c) practicing steps (a) and (b) to produce a fabric scoring between about 4.5 and 5.0 on each of random tumble, pilling, brush pilling, and Klopman method roughing and pilling, tests, and to produce a fabric having a surface SMD of at least about 4.3 microns, a bending rigidity 2 HB of about 0.1 or less, a compressibility EMC % of less than about 28, a shearing stiffness G value of about 2 or less, and an extensibility EMT % of at least about 3.0.

22. A method as recited in claim 21 comprising the further steps of (d) cutting and forming the fabric to produce curtains that can be hung adjacent a transparent or translucent structural element.

23. A method as recited in claim 21 comprising the further steps of (d) cutting and forming the fabric to produce a bedspread which can be placed on a mattress or other bed structure.

* * * * *